US005836515A

United States Patent [19]

Fonzes et al.

[11] Patent Number: 5,836,515

[45] Date of Patent: Nov. 17, 1998

[54] HIGH EFFICIENCY SPRAYING DEVICE, IN PARTICULAR FOR SPRAYING WATER IN THE FORM OF MICRO-DROPLETS

[75] Inventors: Georges Fonzes, Antibes; Michel Gschwind, Grasse; Jean Lauretti, Le Cannet; Gil Ching, Cagnes sur Mer; Daniel Guyomar, Nice; Jean-Denis Sauzade, Grasse, all of France

[73] Assignee: IMRA Europe SA, Valbonne, France

[21] Appl. No.: 778,362

[22] Filed: Jan. 2, 1997

[30] Foreign Application Priority Data

Jan. 4, 1996 [FR] France ..... 96 00048

[51] Int. Cl.[6] ..... B05B 1/08; B05B 1/24

[52] U.S. Cl. ..... 239/102.2; 239/102.1; 239/121; 239/122; 239/136; 261/30; 261/81; 261/DIG. 48

[58] Field of Search ..... 239/102.1, 102.2, 239/121, 122, 132, 136; 261/30, 81, DIG. 48

[56] References Cited

U.S. PATENT DOCUMENTS

| | | | |
|---|---|---|---|
| 4,003,967 | 1/1977 | Potvin | 261/30 |
| 4,410,139 | 10/1983 | Nishikawa et al. | 239/102.2 |
| 5,624,608 | 4/1997 | Ching et al. | 239/102.2 X |
| 5,645,769 | 7/1997 | Tamaru et al. | 261/81 X |
| 5,653,919 | 8/1997 | White et al. | 261/30 X |

FOREIGN PATENT DOCUMENTS

| | | | |
|---|---|---|---|
| 2691411 | 11/1993 | France . | |
| 88 07 489 | 7/1988 | Germany . | |
| 54-124550 | 9/1979 | Japan | 261/81 |

*Primary Examiner*—Andres Kashnikow
*Assistant Examiner*—Robin O. Evans
*Attorney, Agent, or Firm*—Oliff & Berridge, PLC

[57] ABSTRACT

A liquid spraying device including an elongate first vessel closed at one of its ends by a first free face of a piezoelectric transducer capable of emitting waves into a liquid filling the vessel, and open at its end remote from the piezoelectric transducer. The piezoelectric transducer includes a second free face opposite its first free face, and wherein an elongate second vessel is disposed symmetrically to the first vessel relative to the piezoelectric transducer, the second vessel being closed at one of its ends by said second free face of the piezoelectric transducer, which is thus also capable of emitting waves into a liquid filling the second vessel, said second vessel being open at its end remote from the piezoelectric transducer.

11 Claims, 2 Drawing Sheets

HIGH EFFICIENCY SPRAYING DEVICE, IN PARTICULAR FOR SPRAYING WATER IN THE FORM OF MICRO-DROPLETS

The present invention relates to a high efficiency spraying device, in particular for spraying water in the form of micro-droplets.

BACKGROUND OF THE INVENTION

Devices for micro-spraying water are known for use in humidifying ambient air.

Such devices are thus known that include a piezoelectric ceramic transducer excited by a high frequency electrical signal to emit ultrasound waves into a small vessel filled with water.

The waves propagate in the water in non-linear manner and a build-up of static pressure develops towards the surface of the water, causing a jet of liquid called an "acoustic fountain" to appear which is surrounded by a mist of micro-droplets.

An air flow created in the vicinity of the jet of water thus evacuates the micro-droplets to the outside of the device, into the ambient air.

In such a device, only part of the energy supplied by the transducer is used to generate micro-droplets, since that face of the transducer which does not come into contact with the water also emits waves, which waves are absorbed both by the support of the transducer and also in the vessel by multiple reflection, and are lost.

In addition, internal losses within the transducer plus the phenomena of emission level saturation due to high stresses and to temperature rise in the transducer limit the acoustic efficiency thereof.

OBJECTS AND SUMMARY OF THE INVENTION

The present invention seeks to provide a spraying device which has high efficiency, in particular by eliminating the above-mentioned problem.

The present invention provides a liquid spraying device including an elongate first vessel closed at one of its ends by a first free face of a piezoelectric transducer capable of emitting waves into a liquid filling the vessel, and open at its end remote from piezoelectric transducer, wherein the piezoelectric transducer includes a second free face opposite its first free face, and wherein an elongate second vessel is disposed symmetrically to the first vessel relative to the piezoelectric transducer, the second vessel being closed at one of its ends by said second free face of the piezoelectric transducer, which is thus also capable of emitting waves into a liquid filling the second vessel, the second vessel being open at its end remote from the piezoelectric transducer.

It will be understood that by completely immersing the piezoelectric transducer in the two liquids contained in the two vessels, a large amount of heat can be diffused from the transducer to the liquids, thereby restricting the temperature rise of the transducer and thus improving its operation. In addition, the presence of liquid at both faces of the piezoelectric transducer makes the mechanical stresses in the transducer symmetrical and improves the transfer of acoustic energy to the surrounding liquids. In combination, the above-mentioned thermal effects and acoustic effects improve the electroacoustic efficiency of the transducer and thus generate a greater acoustic power in the liquids for the same electrical input power.

Thus the device of the invention has high efficiency since it allows many more droplets to be generated than is possible with only a single vessel.

In a preferred embodiment of the invention, both vessels can be completely filled with liquid.

In another preferred embodiment, the waves emitted by the piezoelectric transducer into each vessel are concentrated in the vicinity of the opening of each vessel, the cross section of each vessel presenting a progressive tapering towards the opening of the vessel.

In a particular embodiment, the portion of each vessel presenting a tapering section presents a circularly symmetrical parabolic shape having its focus situated in the vicinity of the corresponding opening.

Because of this tapering cross section, the liquid contained in each vessel is not very sensitive to accelerations of the surroundings in which the device of the invention is installed.

By way of example, the device of the invention can be installed in a motor vehicle, on a boat, or in an airplane.

In a preferred embodiment of the invention, the walls of each vessel are made of a hard material suitable for reflecting waves, and they are shaped so as to concentrate the waves in the vicinity of the central portion of the opening of each vessel.

Thus, the walls of each vessel fulfil at least two distinct functions, namely: firstly they limit any risk of the liquid overflowing outside the vessel, and secondly they concentrate the waves in the vicinity of the central portion of the opening of the vessel.

In particular embodiment of the invention, each vessel includes heating means in the vicinity of its opening, for example electrical resistances, thereby enabling the temperature of the liquid to be raised just before it is sprayed.

In a variant of this embodiment, a portion of the acoustic energy supplied by the waves is converted into heat, preferably only in the vicinity of the opening of each vessel, and otherwise in the entire wall of each vessel, because of the presence of a sound absorbing material such as a polymer.

To this end, a laminated polyester marketed by the company SOLOPLAST can be used, for example.

The polymer can either be found only in the vicinity of the opening of the vessel, or else it can constitute the entire vessel, in which case wave reflection may not be as good, but is still sufficient to obtain wave concentration in the vicinity of the opening, whilst the walls of the vessel heat all of the liquid contained therein.

Advantageously, the device of the invention is provided with fan means for creating a flow of air in the vicinity of the surface of the liquid contained in each vessel.

In a preferred embodiment of the invention, the device includes a collecting receptacle in which the vessels are placed, a pump being connected firstly to the collecting receptacle and secondly to each vessel, and being capable of causing the liquid to circulate continuously between each vessel from where it overflows and the collecting receptacle where it is collected, a liquid tank also attached to the pump enabling the quantity of liquid circulating in the device to remain constant, by compensating for the liquid consumed in producing the droplets.

Thus the liquid level instability at the opening of each vessel, which could otherwise result from unexpected overflows due to the device being subjected to considerable amounts of acceleration, is compensated mainly by the fact that since the liquid is forced to overflow permanently at the opening of each vessel, even considerable amounts of acceleration can provoke only small fluctuations in the quantity of liquid which overflows, and the level of the liquid at the opening of each vessel is not modified significantly.

Moreover, not only is such a device not very sensitive to accelerations, but furthermore, because of its symmetry and because of the use of forced liquid circulation, it is not very sensitive to variations in inclination and can operate in any position.

Advantageously, the pump rate is high enough to generate a jet of liquid at the opening of each vessel, independently of the acoustic fountain which results from the single action of the ultrasound waves.

In this way, the energy of the waves can be made use of mainly for spraying the liquid, the formation of the acoustic fountains being facilitated by the fact that the jets of liquid are already being created by the pump.

To further increase spraying effectiveness, it is preferable, according to the invention, to select a diameter for the opening of each vessel which is close to that of the acoustic fountain which would be formed naturally by the waves in the absence of the pump, so as to provide best superposition of the jet of water formed by the pump and of the acoustic fountain generated by the waves.

In a preferred embodiment, a deflector is provided in the extension of the opening of each vessel for retaining large drops of liquid, which drops are thus recovered in the collecting receptacle, whilst the air flow generated by the fan means evacuates the micro-droplets towards the outside of the device.

BRIEF DESCRIPTION OF THE DRAWINGS

In order to better understand the invention, an embodiment given by way of non-limiting example is described below with reference to the accompanying drawings, in which.

MORE DETAILED DESCRIPTION

Figure 1:
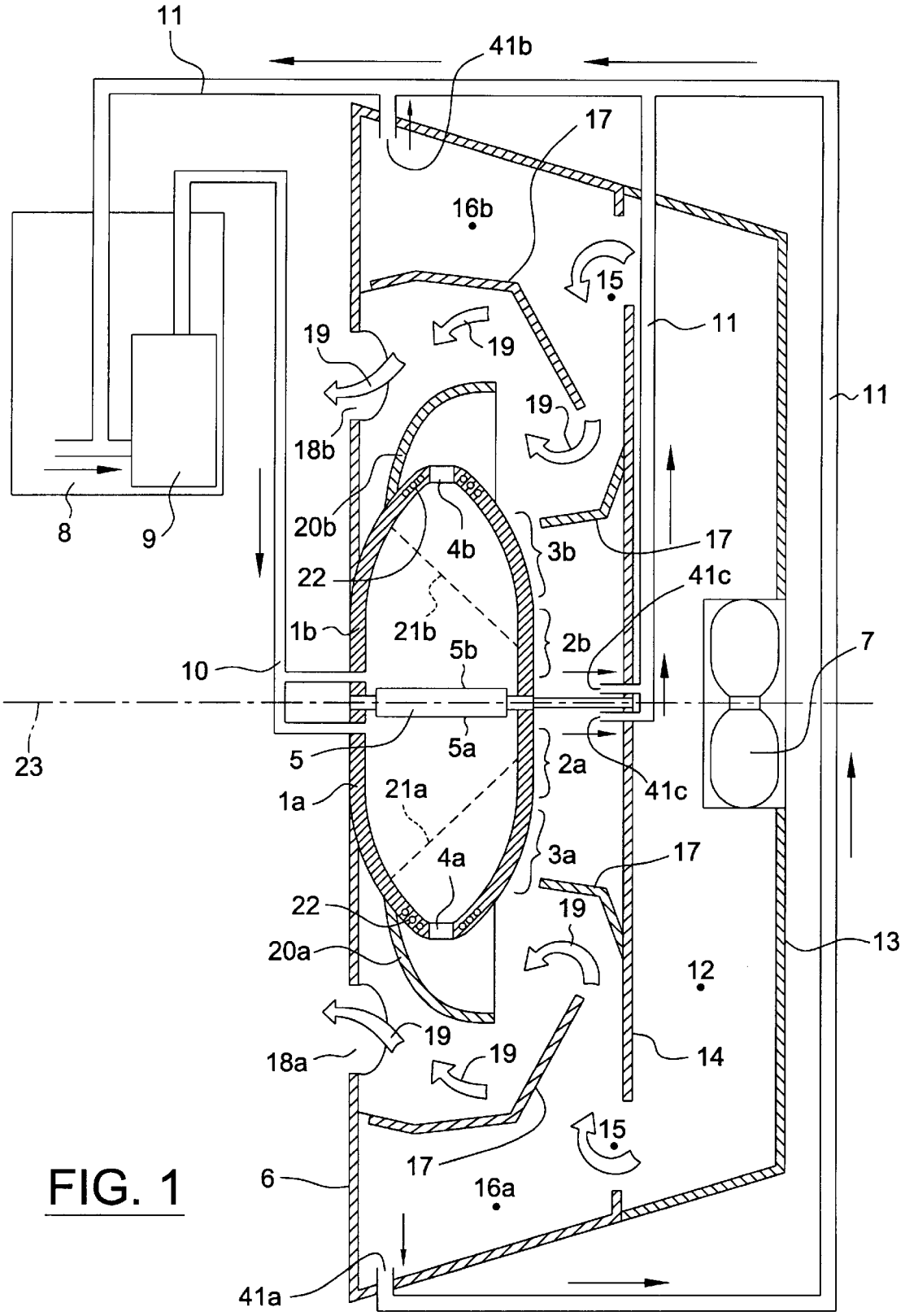
FIG. 1 is a diagrammatic view in elevation and in cross-section of an embodiment of the device of the invention.

The device shown in the drawings comprises two elongate circularly symmetrical vessels 1*a*, 1*b*, each of which includes a cylindrical base 2*a*, 2*b* and an end portion 3*a*, 3*b* whose section tapers towards a respective opening 4*a*, 4*b*.

Figure 2:
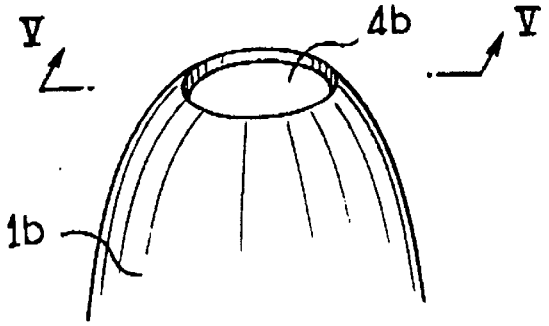
FIGS. 2 to 4 are perspective views of variant shapes for the opening of a vessel of the device of FIG. 1.
Figure 3:
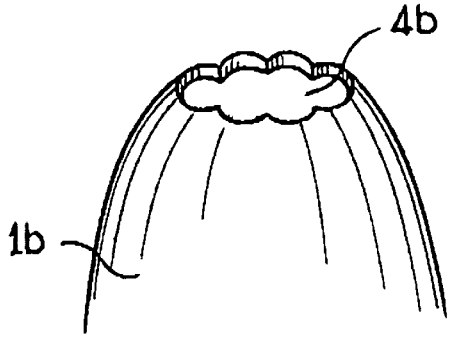
Figure 4:
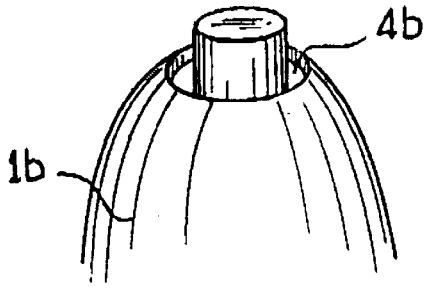

Each opening may be circular as shown in FIG. 2, or scalloped as shown in FIG. 3, or even provided with a central waveguide which occupies its central portion leaving only an annular passage empty, as shown in FIG. 4.

Each vessel 1*a*, 1*b* is intended to be completely filled with water.

A piezoelectric transducer 5 constituted by a disk-shaped ceramic is placed between the two vessels 1*a*, 1*b* remote from their respective openings 4*a*, 4*b*.

The transducer 5, which includes two opposite free faces 5*a*, 5*b* each constituting the end wall of a respective vessel 1*a*, 1*b*, is capable of emitting ultrasound waves into the water contained in each vessel, towards the corresponding opening 4*a*, 4*b*.

The walls of each vessel are made of stainless steel, for example, which is a material that is hard enough to reflect waves while absorbing a minimum amount of energy.

The converging shape of the walls of each vessel is designed to concentrate the waves in the central portion of the corresponding opening.

The vessels 1*a*, 1*b* are housed inside a closed receptacle 6 which constitutes a collecting receptacle in the meaning of the invention.

A fan 7, driven by a motor (not shown), is disposed inside said collecting receptacle 6.

Outside the collecting receptacle 6, a water tank 8 is found in which a pump 9 is housed, the pump being attached firstly to each vessel 1*a*, 1*b* by means of a first duct 10 and secondly to the collecting receptacle 6 by means of a second duct 11 having two openings 41*a* and 41B which open out facing the open ends of each vessel, and two other openings which open out in the vicinity of the transducer 5.

The fan 7 is housed in a common compartment 12 of the collecting receptacle 6. The compartment 12 is defined by an outside wall 13 of the collecting receptacle 6 and by a sealed internal partition 14 which leaves two empty passages 15 going towards compartments 16*a* and 16*b*, each containing one of the vessels.

Air flow is thus created in each compartment 16*a*, 16*b*, between a plurality of deflectors 17 which direct the air to an opening 18*a*, 18*b* through which the air and the water droplets formed above the opening of each vessel escape, as indicated by arrows 19.

The end portion of each vessel 1*a*, 1*b* is enclosed in a deflector in the form of a spherical cap 20*a*, 20*b* having an axis substantially perpendicular to the longitudinal axis of each vessel, and whose concave side faces the displacement direction of the air flow.

Each cap 20*a*, 20*b* is secured to the outside wall of its vessel 1 along a sealed joint 21*a*, 21*b*.

In the vicinity of the opening 4*a*, 4*b* of each vessel, electrical resistances 22 are provided, which are inserted in the thickness of the wall of each vessel and which enable the water to be heated before being sprayed.

The heating power is determined so as to heat only the periphery of the jet in order to restrict electrical power requirements.

Heating can also be obtained by using a portion of the sound waves to heat the end of the vessel, for example by means of a polymer material which heats by absorbing the waves. In preferred manner, the material is sandwiched between two metal walls to protect it from being attacked directly by the waves.

Figure 5:
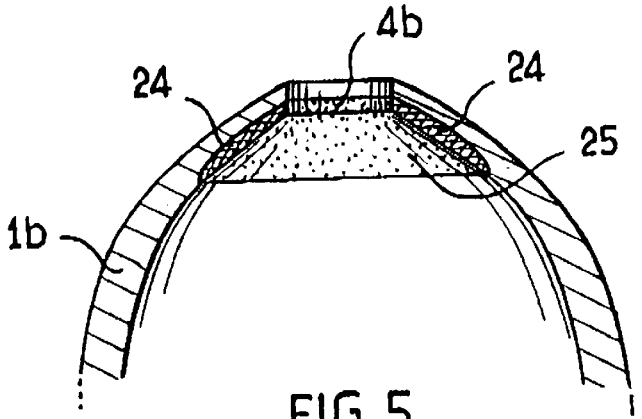
FIG. 5 is a cross-section view on V—V of FIG. 2.

FIG. 5 shows the portion presenting a tapering section of a metal vessel 1*b*, which includes a thickness of a polymer 25 in a recess made on its inside face in the vicinity of its opening 4*b*.

The polymer is covered by a fine metal layer 24 which is several hundred micrometers thick and which is designed to protect said polymer from direct attack by the waves.

In operation, the waves are absorbed in part by the polymer, which heats up and thus raises the temperature of the water.

By acting on the surface tension of the water and on its saturated vapor pressure, this heating creates a parameter compromise favorable to spraying and further increases the efficiency of the device.

It is known experimentally that if the temperature of the liquid is raised from 20° C. to 40° C., then the volume of liquid sprayed is doubled.

The operation of the spraying device shown in the drawings is explained below.

For ease of explanation, it is assumed that the device is vertically orientated, as shown in FIG. 1.

Each vessel is filled with water.

The pump 9 reverses the flow of water via the duct 10 so that a first jet of water squirts out of the opening of vessel 1*b* and a second jet of water flows out of the opening of vessel 1*a*.

Depending on the shape of the openings 4*a* and 4*b*, three examples of which are shown in FIGS. 2 to 4, ring-shaped or daisy-shaped jets of water of circular section are obtained.

Because droplets are generated at the surface of the jet of water, the shapes of the openings of FIGS. 3 and 4 give rise to jets of water having greater surface area and thus increase the production of droplets compared with the simple shape of FIG. 2.

In other words, since the circumferential length of the jets of water is relatively larger with the openings of FIGS. 3 and 4, and since the mist is generated from the surface area of the jets of water, which area is proportional to said circumferential length, the quantity of mist obtained with the openings of FIGS. 3 and 4 is increased.

Of course, the openings 4*a* and 4*b* are not limited to the shapes shown in the drawings.

The water is recovered by the collecting receptacle 6 and put back into circulation by the pump 9, via the duct 11.

The ceramic 5 emits waves into the two vessels, which waves move through the water along planes perpendicular to the longitudinal axis of each vessel.

The converging shape of the walls of each vessel 1*a*, 1*b* concentrate the waves substantially in the central portions of the corresponding openings 4*a*, 4*b*.

The concentration of the energy of the waves in the vicinity of the surface of the water propagates inside the jet, enabling a mist of micro-droplets to be formed surrounding each jet of water.

In a preferred embodiment, the micro-droplets have a diameter of less than 5 micrometers. They are carried towards the outside by the air flow created by the fan 7.

Other, heavier drops are formed and are recovered by the spherical caps 20*a*, 20*b*, and fall under gravity to the bottom of the collecting receptacle 6 to be put back into circulation by the pump 9 in the same way as the unsprayed water resulting from the jets of water.

The diameter of the openings 4*a*, 4*b* is selected so that the waves concentrate in the vicinity of the opening in each vessel.

Thus, the wave energy that is not used for forming the acoustic fountains is used mainly for spraying the water.

In other words, spraying efficiency is increased firstly because the energy of the waves is used mainly for converting the water into spray, while the jets of water are already being formed by the pump, and secondly because the use of a jet assisted by an external pump enables the operating parameters of the device to be better adapted, allowing optimal operation to be achieved in which the length of the jet exceeds the length of the jet that would be created solely by the acoustic pressure due to the waves.

Thus, the surface area of the jet from which the droplets of water can form is further increased.

In addition, as already explained, both faces 5*a* and 5*b* of the transducer 5 are used for generating spray, thereby enabling the production of water droplets to be substantially increased relative to a device which includes only a single vessel.

Because of the various deflectors, it is possible to operate the above-described device while it is in any position, by pivoting the device about an axis 23 perpendicular to the longitudinal axis of the vessels and included in the plane of the drawing.

The water tank 8 allows the pump 9 to keep a constant quantity of water circulating through the device, by compensating for the volume of water evacuated to the outside by micro-spraying.

It is clear that the device, whose overall dimensions are of the order of 4 cm in diameter and 10 cm in length, can be easily installed in a vehicle.

The face that it can operate properly whilst inclined makes it easy to use in any sort of vehicle.

For example, the device of the invention can be installed in the cabin of a motor vehicle with its longitudinal axis inclined by 10 degrees relative to the horizontal, giving it a vertical size of about 5.7 cm which allows it to be housed in the roof of the cabin, for example.

The device of the invention can also be installed in an airplane or on a boat where stability conditions are not very good a priori.

In buildings, solutions in which the jets are vertical can be very useful for generating very large volumes of droplets from a small volume.

In particular, because of gravity, the jet of water emerging from the lower opening is straight and extends as far as the bottom of the lower vessel. Therefore, the humidification volume is increased because the surface area of water is increased.

Naturally, the embodiment described is not limiting and it can be modified as desired without going beyond the ambit of the invention.

We claim:

1. A liquid spraying device including an elongate first vessel closed at one of its ends by a first free face of a piezoelectric transducer capable of emitting waves into a liquid filling the vessel, and open at its end remote from the piezoelectric transducer, wherein the piezoelectric transducer includes a second free face opposite its first free face, and wherein an elongate second vessel is disposed symmetrically to the first vessel relative to the piezoelectric transducer, the second vessel being closed at one of its ends by said second free face of the piezoelectric transducer, which is thus also capable of emitting waves into a liquid filling the second vessel, the second vessel being open at its end remote from the piezoelectric transducer.

2. A device according to claim 1, wherein both vessels can be completely filled with liquid.

3. A device according to claim 2, wherein the waves emitted by the piezoelectric transducer into each vessel are concentrated in the vicinity of the opening of each vessel, the cross section of each vessel presenting a progressive tapering towards the opening of the vessel.

4. A device according to claim 3, wherein, in their portions presenting progressive tapering, the vessels present respective circularly symmetrical parabolic shapes having their focuses situated in the vicinity of the corresponding openings.

5. A device according to claim 1, wherein each vessel includes heating means in the vicinity of its opening, thereby enabling the temperature of the liquid to be raised just before it is sprayed.

6. A device according to claim 5, wherein the heating means provided in the vicinity of the opening of each vessel, are constituted by a thickness of material that absorbs the acoustic energy of the waves.

7. A device according to claim 1, including fan means for creating a flow of air in the vicinity of the surface of the liquid contained in each vessel.

8. A device according to claim 1, wherein the walls of each vessel are made of a hard material suitable for reflecting waves, and they are shaped so as to concentrate the waves at a point situated in the vicinity of the central portion of the opening of each vessel.

9. A device according to claim 1, including a collecting receptacle in which the vessels are placed, a pump being connected firstly to the collecting receptacle and secondly to each vessel, and being capable of causing the liquid to circulate continuously between the vessels from where it overflows and the collecting receptacle where it is collected, a liquid tank also being attached to the pump so that the quantity of liquid circulating in the device remains constant.

10. A device according to claim 9, wherein each opening of the vessels has a diameter close to that of the acoustic fountain which would be formed naturally by the waves in the absence of the pump.

11. A device according to claim 9, wherein deflectors, in the form of spherical caps for example, are provided in the extension of the opening of each vessel for retaining large drops of liquid, which drops are thus recovered in the collecting receptacle.

* * * * *